US005733155A

United States Patent [19]

Sagawa

[11] Patent Number: 5,733,155

[45] Date of Patent: Mar. 31, 1998

[54] FEMALE CONTACT

[75] Inventor: Tetsuya Sagawa, Yamato, Japan

[73] Assignee: The Whitaker Corporation, Wilmington, Del.

[21] Appl. No.: 659,611

[22] Filed: Jun. 6, 1996

[30] Foreign Application Priority Data

Jul. 28, 1995 [JP] Japan ..... 7-193794

[51] Int. Cl.[6] ..... H01R 13/11

[52] U.S. Cl. ..... 439/852

[58] Field of Search ..... 439/852, 851, 439/850, 845, 843, 842

[56] References Cited

U.S. PATENT DOCUMENTS 5,536,186 7/1996 Watanabe ..... 439/843
5,593,328 1/1997 Okada et al. ..... 439/851
5,630,738 5/1997 Ito et al. ..... 439/851
5,634,825 6/1997 Maki ..... 439/845

FOREIGN PATENT DOCUMENTS 2225183 5/1990 United Kingdom ..... 439/851

*Primary Examiner*—Gary F. Paumen
*Assistant Examiner*—Brian J. Biggi
*Attorney, Agent, or Firm*—Bradley N. Ditty

[57] ABSTRACT

The object of the present invention is to provide a female contact in which plastic deformation of a spring contact member is prevented. A front wall 30 which faces in the direction of engagement is formed by being bent from a front end of an upper wall 16 of a female contact 10. An insertion opening 32 into which the male contact 40 is inserted is formed in front wall 30. Furthermore, a guide plate 34 is provided to guide the male contact 40 into engagement with spring contact member 28 and to protect member 28 from being deformed.

22 Claims, 4 Drawing Sheets

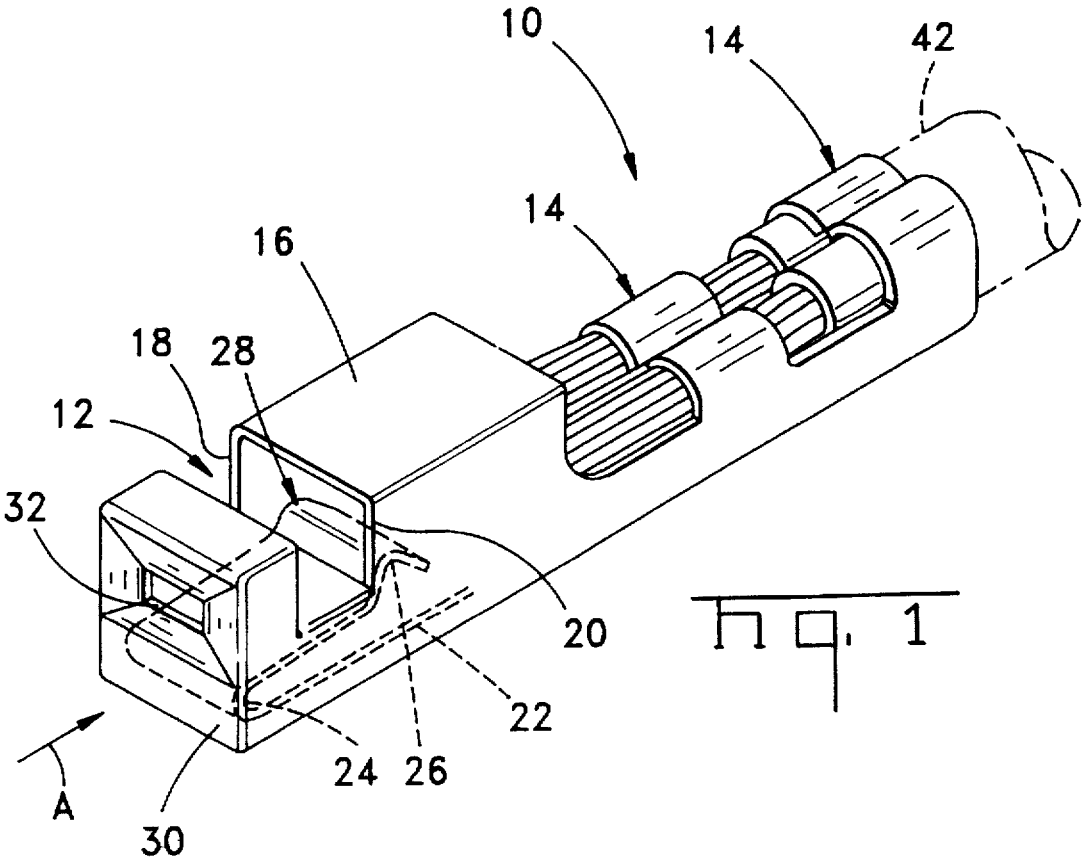
Fig. 1
Fig. 2
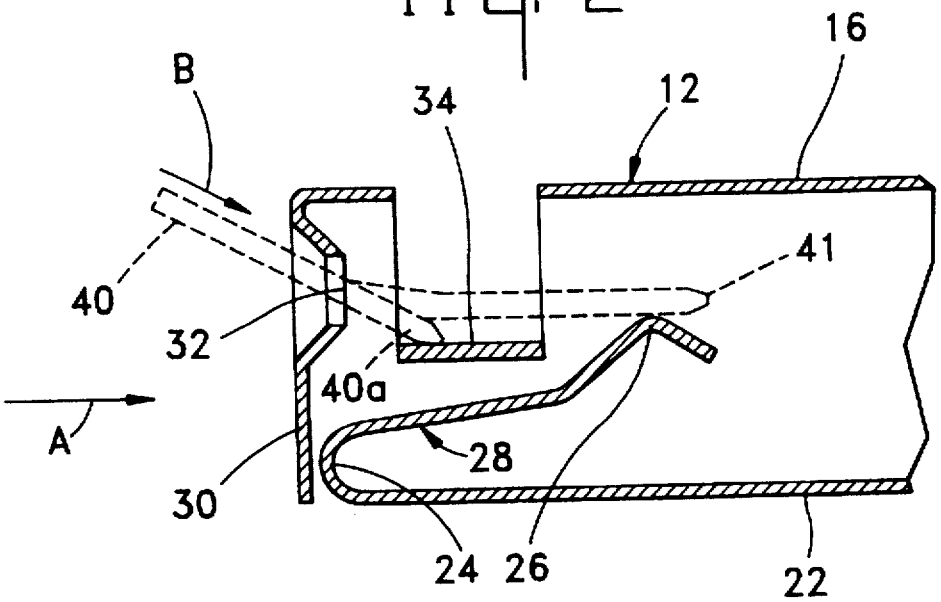

FEMALE CONTACT

FIELD OF THE INVENTION

The present invention relates to a female contact which electrically engages with an inserted male contact.

BACKGROUND OF THE INVENTION

Female contacts which are aligned in plug housings, and which are equipped with male contact receiving sections that receive male contacts aligned in cap housings, and electrical wire termination sections in which electrical wires are terminated, are known. Generally, such female contacts are formed by bending a conductive metal plate, and are equipped with a spring contact member which engages the inserted male contact by clamping the male contact between the spring contact member and an upper wall, and a supporting member which urges the spring contact member toward the wall. This supporting member causes the male contact to be firmly clamped between the upper wall and the spring contact member.

Male contacts are usually inserted into female contacts from the direction of engagement; in some cases, however, male contacts are inserted toward the spring contact member from a direction which intersects the direction of engagement (i.e., from an oblique direction). In such cases, if the spring contact member is pressed strongly downward by the tip portion of the male contact, a force exceeding the elastic limit of the spring contact member may act on the spring contact member, so that the spring contact member undergoes deformation. Furthermore, the spring contact member may similarly undergo deformation if pressed strongly downward with a tool such as a screwdriver or the like.

In light of the above, the object of the present invention is to provide a female contact in which deformation of the spring contact member is prevented.

SUMMARY OF THE INVENTION

A first female contact of the present invention which achieves the abovementioned object, comprises a bottom wall which widens in the direction of engagement; a spring contact member has a contact section that is engaged with a male contact and is moved downwardly, and is positioned above and along the bottom wall; a front wall is positioned at an end of the bottom wall from which the male contact is inserted and faces in the direction of engagement, and has an insertion opening into which the male contact is inserted; and a guide plate extends parallel to the bottom wall in a position above the bottom wall which is closer to the bottom wall than the insertion opening is, and which is closer to both the bottom wall and the front wall than the contact section is.

Furthermore, a second female contact of the present invention comprises a bottom wall which widens in the direction of engagement; a spring contact member positioned above the bottom wall, extends from a front end of the bottom wall where a male contact is inserted and extends toward a rear end of the bottom wall so that a free end portion of the spring contact member is higher than a front end portion of the spring contact member, and is engaged by the male contact; and a guide plate is located at the front end portion of the spring contact member so that the guide plate is lower than the free end portion of the spring contact member.

BRIEF DESCRIPTION OF THE DRAWINGS

Embodiments of the present invention will now be described by way of example with reference to the accompanying drawings in which:

FIG. 1 is a perspective view of a female electrical contact of the present invention.

FIG. 2 is a part cross-sectional view of a contact section of the female contact of FIG. 1.

DETAILED DESCRIPTION OF THE INVENTION

Figure 3:
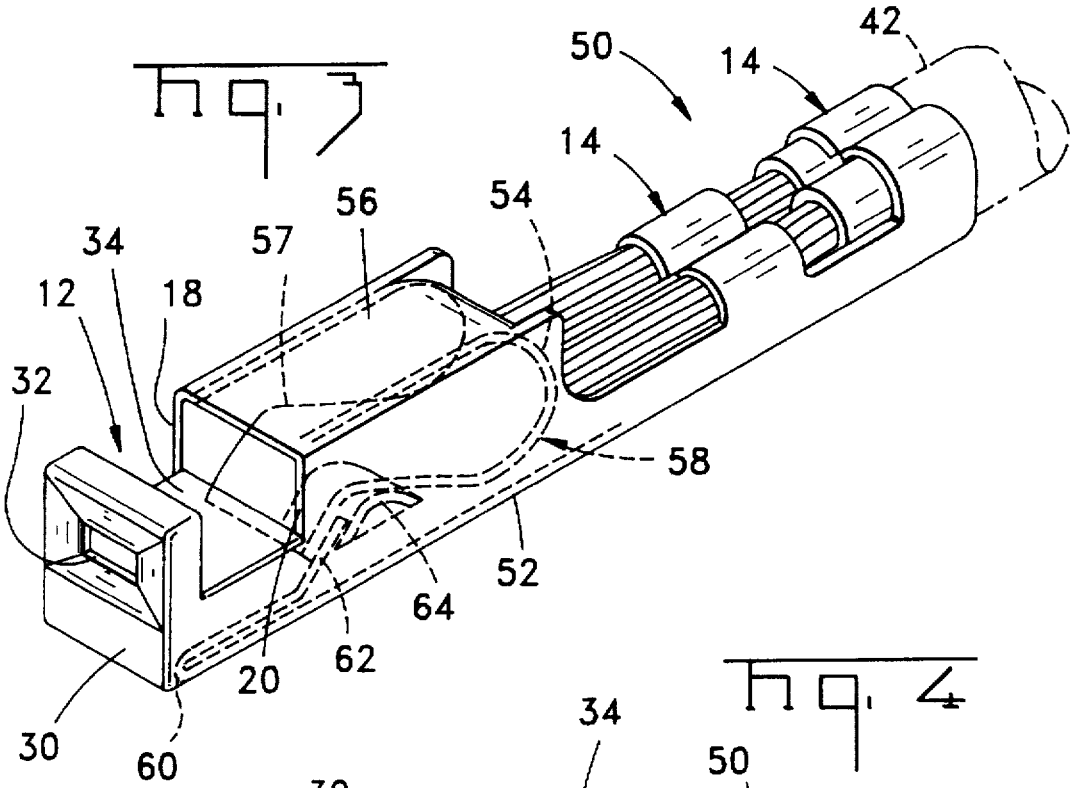
FIG. 3 is a perspective view of an alternative embodiment of a female electrical contact.

Female contact 10 is formed by stamping and forming a plate made of a copper alloy such as phosphor bronze or the like, into a specified shape. Female contact 10, as shown in FIGS. 1 and 2, has a male contact receiving section 12 which receives a male contact 40, and an electrical wire termination section 14 in which an electrical wire 42 is terminated. The male contact receiving section 12 is substantially box-shaped which has an upper wall 16, side walls 18, 20 and a bottom wall 22. A spring contact member 28, which is bent backward and inward from a bent portion 24 located at a front end of the bottom wall 22 where the male contact 40 is inserted and which has a contact section 26 that engages the male contact 40, is positioned inside the male contact receiving section 12 so that this spring contact member 28 has spring properties.

Furthermore, a front wall 30, which faces in the direction of engagement (i.e., the direction indicated by arrow A), is provided on the female contact 10 by being bent downwardly from a front end of the upper wall 16. An insertion opening 32 into which the male contact 40 is inserted is formed in the front wall 30. It is necessary only that the front wall 30 be positioned at the end of the bottom wall 22 from which the male contact is inserted, and that this front wall 30 face in the direction of engagement; it would also be possible to form the front wall 30 by bending inwardly one of the side walls 18 and 20.

Furthermore, a guide plate 34, which is disposed substantially parallel to the bottom wall 22, is also formed in the female contact 10. The guide slate 34 is formed by cuts made in the upper wall 16 and side walls 18, 20, and bending the walls inwardly. This guide plate 34 is formed in a position above the bottom wall 22, is closer to the bottom wall 22 than the insertion opening 32 is, and is closer to both the bottom wall 22 and the front wall 30 than the contact section 26 is. Accordingly, when the male contact 40 is inserted toward the guide plate 34 via the insertion opening 32 in the front wall 30 from a direction (e.g., the direction indicated by arrow B) which intersects the direction of engagement (i.e., the direction indicated by arrow A), the tip portion 40*a* of the male contact 40 engages the guide plate 34. The male contact 40 is guided by the guide plate 34 so that the male contact 40 is inserted substantially in the direction of engagement. As a result, the male contact 40 is smoothly engaged with the female contact 10, and engages the contact section 26 of the spring contact member 28, as shown by the male contact 40 indicated by a broken line. Accordingly, the strong downward pressing of the spring contact member 28 by the tip portion 40*a* of the male contact 40 so that a force exceeding the elastic limit of the spring contact member 28 can be prevented, thus preventing deformation of the spring contact member 28. As a result, the reliability of electrical engagement between the female contact 10 and the male contact 40 is improved.

Figure 4:
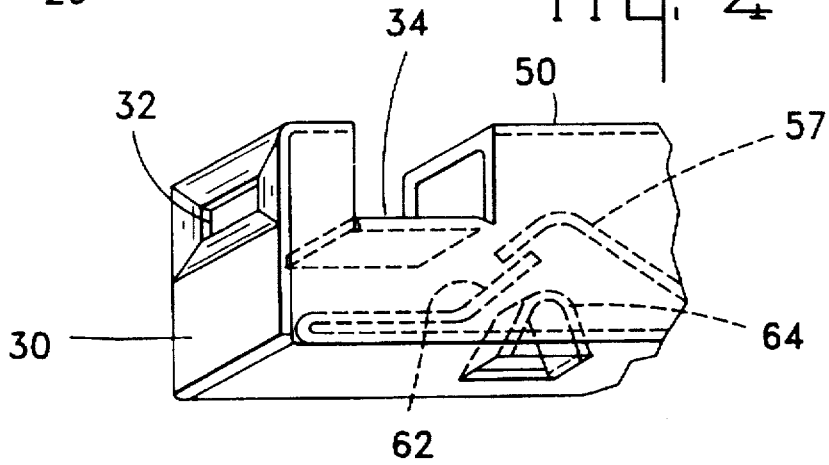
FIG. 4 is a part bottom perspective view of a contact section of the female contact of FIG. 3.
Figure 5:
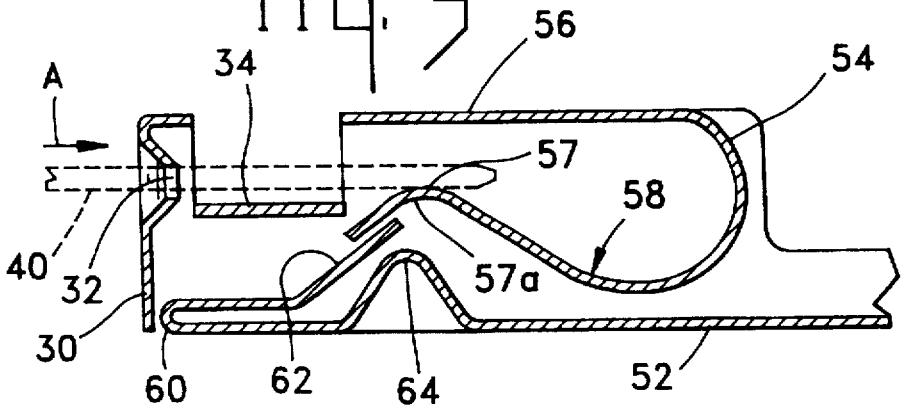
FIG. 5 is a part cross-sectional view of the contact section of the female contact of FIG. 3.
Figure 6:
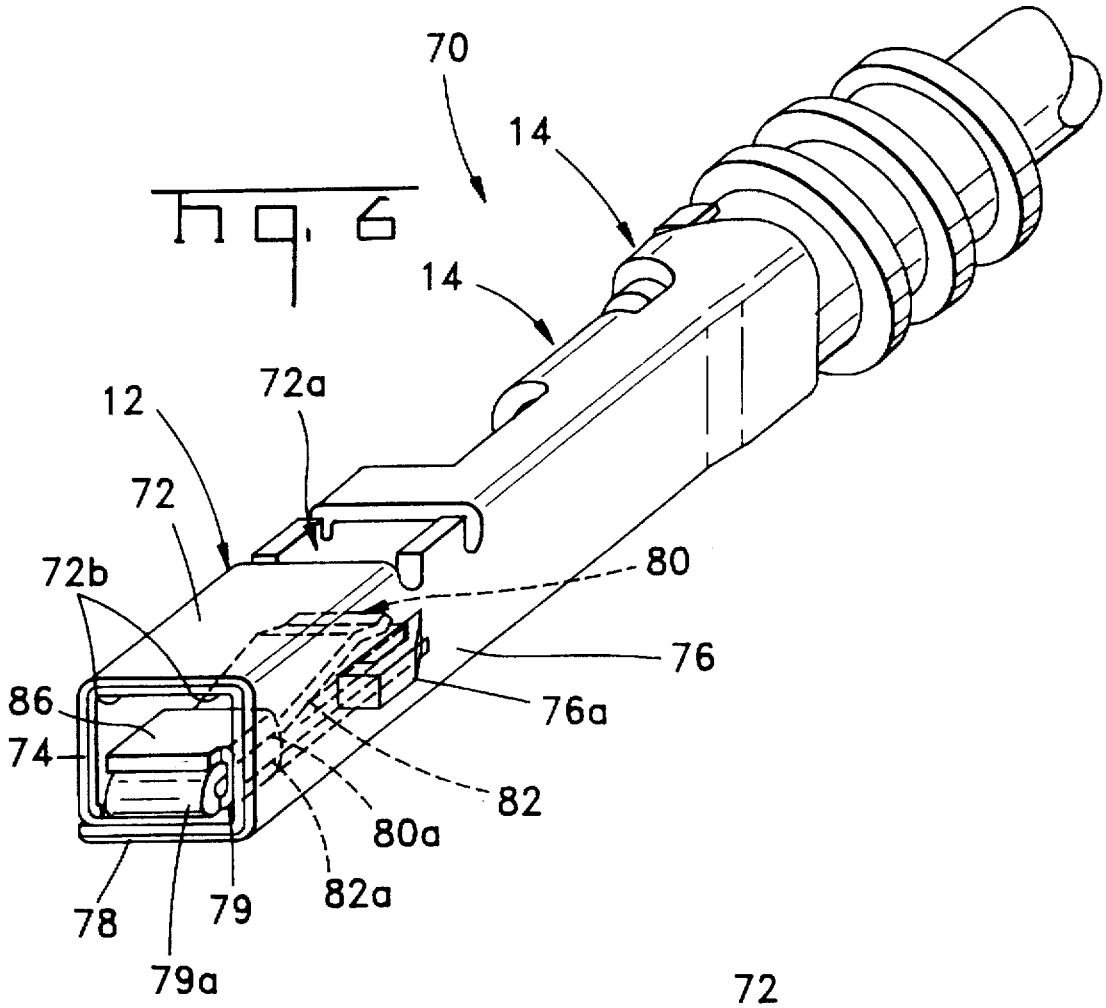
FIG. 6 is a perspective view of another alternative embodiment of a female electrical contact.
Figure 7:
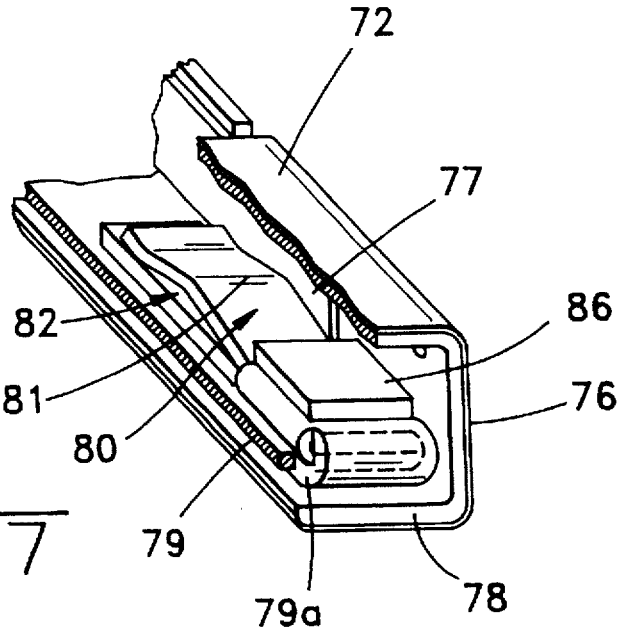
FIG. 7 is a part cut-away perspective view of a contact section of the female contact of FIG. 6.
Figure 8:
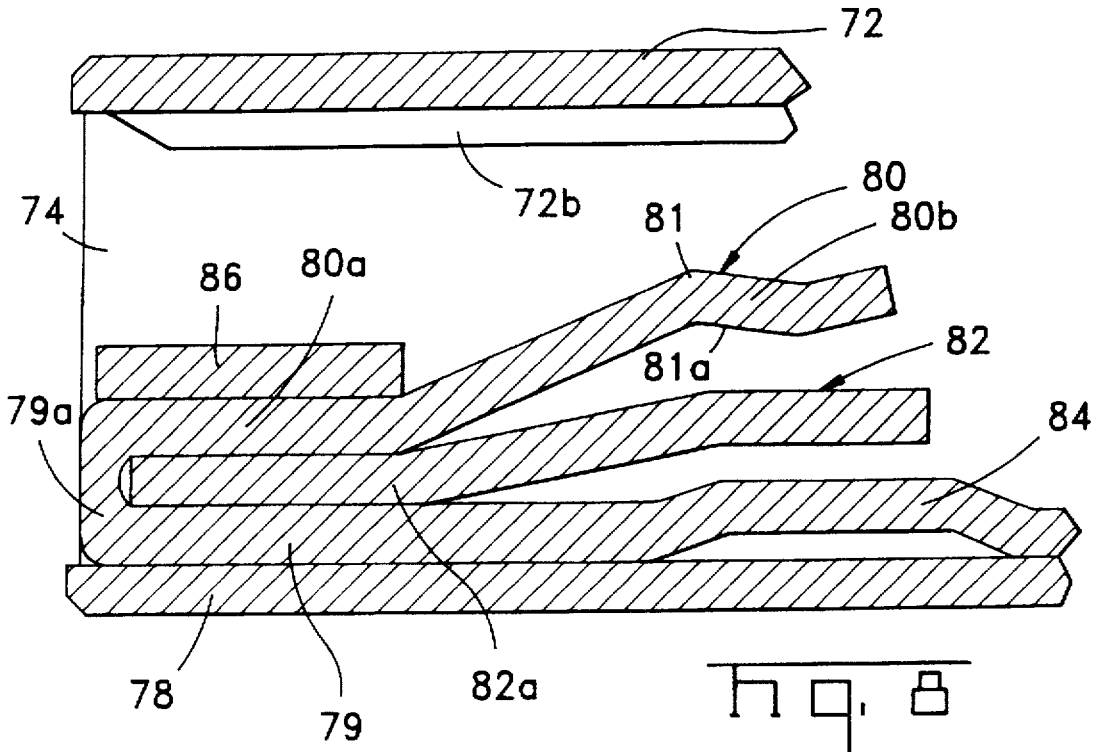
FIG. 8 part cross-sectional view of FIG. 7.

FIGS. 3–5 illustrate a second embodiment of the female contact. Constituent elements which are the same as constituent elements of the female contact 10 shown in FIGS. 1 and 2 are indicated by the same reference numbers.

Female contact 50 is formed by stamping and forming a plate made of a copper alloy such as brass or the like into a specified shape. Like the female contact 10 shown in FIGS. 1 and 2, the female contact 50 is equipped with a male contact receiving section 12 and an electrical wire termination section 14. The male contact receiving section 12 is substantially box-shaped which has an upper wall 56, side walls 18, 20 and a bottom wall 52. A spring contact member 58, which is bent forward and inward from a bent portion 54 located at the rear end of the upper wall 56, and which has a projecting contact section 57 that engages the male contact 40, is positioned inside the male contact receiving section 12 so that this spring contact member 58 has spring properties. This spring contact member 58 is longer than the spring contact member 28 in FIGS. 1 and 2, and therefore has good spring properties. Furthermore, as in the case of the female contact 10 shown in FIG. 1, a front wall 30 which faces in the direction of engagement (the direction indicated by arrow A) is provided by the female contact 50, and an insertion opening 32 is also located therein.

Furthermore, a support member 62, which is bent backward and inward from a bent portion 60 located at a front end of the bottom wall 52 (where the male contact 40 is inserted), and which is engagable with the undersurface 57*a* of the contact section 57 of the spring contact member 58, is located beneath the spring contact member 58. This support member 62 has the function of increasing the contact pressure between the spring contact member 58 and the male contact 40, and is arranged so that when the male contact 40 engages the spring contact member 58 and thus causes the spring contact member 58 to bend downward, the support member 62 supports the spring contact member 58 from below and constitutes a spring assist member. Furthermore, a projection 64, which is caused to protrude inwardly by deep drawing of the bottom wall 52, is located beneath the contact section 57 of the spring contact member 58. This projection 64 has the function of preventing deformation of the spring contact member 58 and support member 62 in cases where the spring contact member 58 is pushed excessively downward so that the support member 62 is also pushed excessively downward.

FIGS. 6–9 illustrate a third embodiment of the female contact.

The female contact 70 is formed by stamping and forming a plate made of a copper alloy such as phosphor bronze or the like into a specified shape. Like the female contact 10 shown in FIG. 1, the female contact 70 is equipped with a male contact receiving section 12 and an electrical wire termination section 14. The male contact receiving section 12 is substantially box-shaped which has an upper wall 72, a side wall 74, double side walls 76, 77 and double bottom walls 78, 79. A spring contact member 80, which is engaged by the male contact, a support member 82, which engages the undersurface 81*a* of the contact section 81 of the spring contact member 80, a projection 84, which is positioned beneath the support member 82, and a guide plate 86 which protects the front end portion of the spring contact member 80, are formed inside the male contact receiving section 12.

Figure 9:
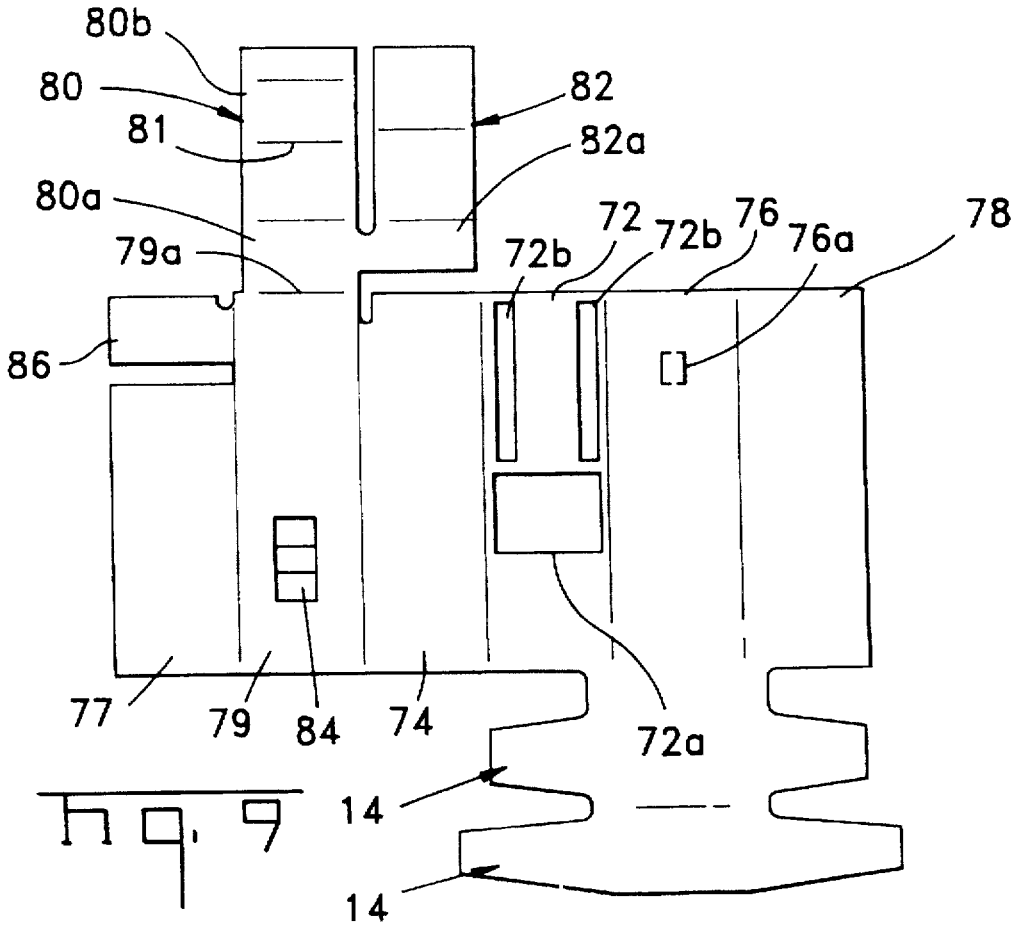
FIG. 9 is a plan view of a blank of metal from which the female contact of FIG. 6 is to be formed.

As is clearly shown in FIG. 9, the spring contact member 80 is formed by bending a plate (i.e., the spring contact member 80) connected to the bottom wall 79 so that the rear end portion 80*b* extends rearward from the front bent end 79*a* of the bottom wall 79 in a higher position than the front end portion 80*a*. The guide plate 86 is superimposed on the front end portion 80*a* so that this guide plate 86 is lower than the rear end portion 80*b*. The support member 82 is formed by bending a plate (i.e., the support member 82) connected to the spring contact member 80 so that the front end portion 82*a* of the member 82 is laid together with the spring contact member 80. This support member 82 has the function of increasing the contact pressure between the spring contact member 80 and the male contact, and is arranged so that when the male contact engages the spring contact member 80 and causes the spring contact member 80 to bend downward, the support member 82 supports the spring contact member 80 from below thereby operating as an assist spring. The projection 84 is formed by causing a portion of the bottom wall 79 to project inwardly. This projection 84 has the function of preventing deformation of the spring contact member 80 and support member 82 in cases where the spring contact member 80 is pushed excessively downward so that the support member 82 is also pushed excessively downward.

Furthermore, an opening 72*a* which engages with a housing lance formed in the housing (not shown in the drawings), and semi-cylindrical and inwardly-directed projections 72*b*, which are to insure smooth insertion of the male contact, are formed in the upper wall 72. In addition, an outwardly-directed projection 76*a*, which fits into a groove in the housing and determines the orientation of the contact 70, is formed on the side wall 76.

In the female contact 70 constructed as described above, when the male contact is inserted toward the guide plate 86 in a direction which crosses the direction of engagement, the tip portion of the male contact engages the guide plate 86. The tip portion of the male contact that has engaged the guide plate 86 then advances along the plate 86, and engages the rear end portion 80*b* of the spring contact member 80 without engaging the front end portion 80*a* of the spring contact member 80. Accordingly, the action of a force exceeding the elastic limit of the spring contact member 80 as a result of the front end portion 80*a* of the spring contact member 80 being pushed strongly downward by the tip portion of the male contact can be prevented, so that plastic deformation of the spring contact member 80 is prevented.

Thus, in the first female contact of the present invention, when the male contact is inserted toward the guide plate via the insertion opening in the front wall in a direction which crosses the direction of engagement, the tip portion of the male contact engages the guide plate. In this case, the guide plate is formed substantially parallel to the bottom wall; accordingly, the male contact is guided by the guide plate is a direction which is substantially parallel to the direction of engagement. As a result, the male contact is smoothly engaged with the female contact, and engages the contact section of the spring contact member. Accordingly, the action of a force exceeding the elastic limit of the spring contact member as a result of the spring contact member being pushed strongly downward by the tip portion of the male contact can be prevented, so that plastic deformation of the spring contact member is prevented. Furthermore, in the second female contact of the present invention, when the male contact is inserted toward the guide plate in a direction which crosses the direction of engagement, the tip portion of the male contact engages the guide plate. The tip portion of the male contact that has engaged the guide plate then advances along the guide plate, and engages the rear end portion of the spring contact member without engaging the front end portion of the spring contact member. Accordingly, the action of a force exceeding the elastic limit of the spring contact member as a result of the front end portion of the spring contact member being pushed strongly downward by the tip portion of the male contact can be prevented, so that plastic deformation of the spring contact member is prevented.

I claim:

1. A female electrical contact comprises a male contact-receiving section having upper, lower and side walls for receiving a male contact therein, a termination section for termination to an electrical wire, a spring contact member within said male contact-receiving section having a contact section for electrical engagement with the male contact when inserted into the contact-receiving section, characterized in that a guide plate is integrally formed with said contact-receiving section and is located at a front end of said contact-receiving section extending across the contact-receiving section parallel to the lower wall and forward of said contact section for engagement by a tip portion of the male contact to guide the male contact into engagement with the contact section and prevent the male contact from deforming the spring contact member.

2. A female electrical contact as claimed in claim 1, wherein the guide plate extends across said spring contact member.

3. A female electrical contact as claimed in claim 1, wherein the male contact-receiving section has a front wall provided with an opening through which the male contact is inserted, said opening being located above said guide plate.

4. A female electrical contact as claimed in claim 1, wherein the spring contact member is bent backwardly and inwardly from a bent portion located at a front end of the bottom wall.

5. A female electrical contact as claimed in claim 1, wherein the spring contact member is bent forwardly and inwardly from a bent portion located at a rear end of the upper wall.

6. A female electrical contact as claimed in claim 5, wherein a support member is bent backwardly and inwardly from a bent position located at a front end of the bottom wall and which is engagable with an undersurface of said spring contact member.

7. A female electrical contact as claimed in claim 6, wherein a projection protrudes inwardly from the bottom wall and is located beneath said support member.

8. A female electrical contact as claimed in claim 1, wherein the spring contact member is connected to the bottom wall at a front bent end thereof and extends rearwardly and inwardly so that a rear end portion of the spring contact member is at a higher position than a front end portion of said spring contact member.

9. A female electrical contact as claimed in claim 8, wherein said guide plate is superimposed on the front end portion of the spring contact member so that the guide plate is lower than the rear end portion of the spring contact member.

10. A female electrical contact as claimed in claim 8, wherein a support member has a front end section disposed within the front bent end of the bottom wall and extends rearwardly and inwardly along said spring contact member.

11. A female electrical contact as claimed in claim 10, wherein a protection protrudes inwardly from the bottom wall and is located beneath the support member.

12. A female electrical contact, comprising:

a box-shaped male contact-receiving section having upper, lower and side walls for receiving a male contact therein;

a termination section for termination to an electrical wire;

a spring contact member within the male contact-receiving section having a contact section for electrical engagement with a male contact when inserted into the male contact-receiving section; and a guide plate integrally formed with said contact-receiving section and located at a front end of said male contact-receiving section extending across the contact-receiving section parallel to the lower wall and forward of said contact section and at a position lower than said contact section for engagement by a tip portion of the male contact to guide the male contact into electrical engagement with the contact section and prevent the male contact from deforming the spring contact member.

13. A female electrical contact as claimed in claim 12, wherein the guide plate extends across the spring contact member.

14. A female electrical contact as claimed in claim 12, wherein the male contact-receiving section has a front wall provided with an opening through which the male contact is inserted, said opening being located above said guide plate.

15. A female electrical contact as claimed in claim 12, wherein the spring contact member is bent backwardly and inwardly from a bent portion located at a front end of the bottom wall.

16. A female electrical contact as claimed in claim 12, wherein the spring contact member is bent forwardly and inwardly from a bent portion located at a rear end of the upper wall.

17. A female electrical contact as claimed in claim 16, wherein a support member is bent backwardly and inwardly from a bent portion located at a front end of the bottom wall and which is engagable with an undersurface of said spring contact member.

18. A female electrical contact as claimed in claim 17, wherein a projection protrudes inwardly from the bottom wall and is located beneath said support member.

19. A female electrical contact as claimed in claim 12, wherein the spring contact member is connected to the bottom wall at a front bent end thereof and extends rearwardly and inwardly so that a rear end portion of the spring contact member is at a higher position than a front end portion of the spring contact member.

20. A female electrical contact as claimed in claim 19, wherein said guide plate is superimposed on the front end portion of the spring contact member so that the guide plate is lower than the rear end portion of the spring contact member.

21. A female electrical contact as claimed in claim 20, wherein a projection protrudes inwardly from the bottom wall and is located beneath the support member.

22. A female electrical contact as claimed in claim 19, wherein a support member has a front end section disposed within the front bent end of the bottom wall and extends rearwardly and inwardly along said spring contact member.

* * * * *